US005793280A

United States Patent [19]

Hincher

[11] Patent Number: 5,793,280

[45] Date of Patent: Aug. 11, 1998

[54] BRACKET HAVING INTEGRAL LOCATING BEACON

[76] Inventor: William Hincher, 23 Pittenger Pond Rd., Freehold, N.J. 07728

[21] Appl. No.: 824,353

[22] Filed: Mar. 25, 1997

[51] Int. Cl.[6] ..... G08B 27/00; A62C 25/00

[52] U.S. Cl. ..... 340/326; 340/691; 169/51

[58] Field of Search ..... 340/326, 321, 340/332, 289, 541, 551, 552, 982, 691; 169/51, 46

[56] References Cited

U.S. PATENT DOCUMENTS

| | | | |
|---|---|---|---|
| D. 244,392 | 5/1977 | Montambo | D29/126 |
| D. 266,061 | 9/1982 | Wenzlaff | D10/114 |
| 4,015,250 | 3/1977 | Fudge | 169/51 |
| 4,034,697 | 7/1977 | Russell | 169/51 |
| 4,548,274 | 10/1985 | Simpson | 169/51 |
| 4,787,460 | 11/1988 | Clarkson | 169/51 |
| 4,981,453 | 1/1991 | Krishan et al. | 441/6 |
| 5,075,671 | 12/1991 | Livingston, III | 340/326 |
| 5,123,490 | 6/1992 | Jenne | 169/51 |
| 5,153,567 | 10/1992 | Chimento | 169/51 |
| 5,408,771 | 4/1995 | Manrubia | 40/714 |
| 5,412,887 | 5/1995 | Layne | 40/714 |
| 5,515,036 | 5/1996 | Waraksa et al. | 340/825.72 |

FOREIGN PATENT DOCUMENTS

| | | | |
|---|---|---|---|
| 6165838 | 6/1994 | Japan | 169/51 |

*Primary Examiner*—Jeffery A. Hofsass
*Assistant Examiner*—Van T. Trieu
*Attorney, Agent, or Firm*—Terrance L. Siemens

[57] ABSTRACT

A fire extinguisher bracket having a beacon for rendering the fire extinguisher conspicuous even in a darkened location. The bracket has structure for engaging the fire extinguisher and structure for mounting the bracket to an environmental surface. The beacon may be audible or visible or both, and may be arranged for constant or intermittent operation. A battery carried by the bracket powers the beacon. Optionally, beacon operation is switched to conserve battery power. Both manual and automatic switches may be included. Automatic switches, if provided, operate the beacon subject to a specified condition, such as detection of motion, thereby assuring likelihood of human presence, and detection of placement of a fire extinguisher within the bracket. Switches may be arranged for selective manual and automatic operation of the beacon.

11 Claims, 3 Drawing Sheets

BRACKET HAVING INTEGRAL LOCATING BEACON

BACKGROUND OF THE INVENTION

1. Field of the Invention

The present invention relates to an improvement to brackets, the improvement comprising incorporation of a signalling beacon. The beacon visually or audibly indicates location of the bracket. A particularly critical application of the invention is to signal the location of a fire extinguisher in a room or corridor of a building which has been darkened by intentional or damage responsive interruption of lighting.

2. Description of the Prior Art

Certain objects are intended for emergency use, and locating the same during an emergency is of the essence. An example is a fire extinguisher. Fire extinguishers are generally mounted to environmental surfaces, such as building walls or walls of a motor vehicle. In the event of a fire or similar emergency situation calling for utilization of the fire extinguisher, the mere act of locating the fire extinguisher may present a problem. It may be that in the event of a fire, smoke obscures the location of the fire extinguishers Alternatively, lighting within a building or motor vehicle may be interrupted either intentionally to mitigate propensity for damage or in response to damage which has already occurred.

Any of these situations may render a fire extinguisher difficult to locate in the moment of need. Yet at this time, it is most critical that the fire extinguisher be conspicuous. There remains a need for ability of a fire extinguisher to remain conspicuous in conditions of poor illumination within a structure.

U.S. Pat. No. 4,787,460, issued to Joseph G. Clarkson on Nov. 29, 1988, further describes the problem and proposes a visual solution for the problem. The solution proposed by Clarkson takes the form of a covering or mounting plate for a fire extinguisher mounted in a building which is brightly marked in distinctive patterns for making the mounting of the fire extinguish conspicuous. However, under conditions wherein ambient illumination is very weak or absent, even the bright and distinctive markings of Clarkson are susceptible to being rendered ineffectively conspicuous. By contrast, the present invention provides a self-illuminated bracket, which generates its own illumination, thereby overcoming inadequate ambient lighting.

A bracket for a fire extinguisher is shown in U.S. Pat. No. Design 244,392, issued to Roger Jay Montambo on May 17, 1977. This device is representative of fire extinguisher brackets generally, showing critical characteristics thereof, and lacks lighting of any type.

A bracket having an associated light is shown in U.S. Pat. No. Design 266,061, issued to Karl H. Wenzlaff on Sep. 7, 1982. However, unlike the present invention, Wenzlaff's bracket is intended to support the light and not a second object, such as a fire extinguisher.

U.S. Pat. No. 5,408,771, issued to Bob Manrubia on Apr. 25, 1995, and U.S. Pat. No. 5,412,887, issued to James R. Layne on May 9, 1995, describe, respectively, an illuminated box frame and an illuminated cabinet. In both cases, the subject invention nearly fully envelopes the enclosed object. By contrast, the present invention is a bracket having a limited number of bands engaging the enclosed object along a limited area of its outer surface. This characteristic exposes a significant portion of the supported object, which has the effect of suggesting or revealing how to disengage the object from its support. This is important in the case of fire extinguishers, which may well be required to be deployed expeditiously when their necessity arises.

None of the above inventions and patents, taken either singly or in combination, is seen to describe the instant invention as claimed.

SUMMARY OF THE INVENTION

The present invention combines a suitable, conventional mounting for a fire extinguisher with a self-contained beacon for rendering the fire extinguisher conspicuous. The beacon may be audible, visual, or both. The mounting for the fire extinguisher has structure for engaging the fire extinguisher and structure for mounting the bracket to an environmental surface.

Preferably, the bracket incorporates conventional structural features for engaging the fire extinguisher, such as a band for encircling a cylindrical fire extinguisher. Structure for mounting the bracket to an environmental surface may include a plate having holes for receiving fasteners, for wall mounting. Recessed mounting may be accommodated by providing a frame suitable for mounting in a recess in a wall. Still other mounting structure is possible, such as a floor stand.

The beacon is preferably provided with independent power, such as batteries carried on board the novel bracket. This renders illumination independent of any power connection to a building, which power connection is susceptible to interruption during a fire. Controls are optionally provided for deenergizing or otherwise regulating the beacon. The beacon may be turned on, turned off, and connected to a secondary controller which responds to certain conditions. An example of the latter is a proximity detector, which links beacon operation to inference of human activity. Since most human activities involve motion, the beacon could be operative only when human presence is inferred, so as to conserve battery power and avoid interruption of operation for service.

A second example is a proximity switch energizing the beacon when the fire extinguisher is supported by the bracket. This feature avoids battery depletion when the fire extinguisher is removed for use, service, transport, or instruction of personnel.

Accordingly, it is a principal object of the invention to provide a bracket for supporting a fire extinguisher, the bracket having a beacon for rendering the fire extinguisher conspicuous.

It is another object of the invention to provide power for the beacon which renders the novel bracket independent of connection to power from an external structure.

It is a further object of the invention to provide a self-illuminating visual beacon.

Still another object of the invention is to provide an audible beacon.

An additional object of the invention is to provide controls for deenergizing the beacon when desired.

It is again an object of the invention to conserve power of the power supply of the novel bracket, thereby extending a period of service during which the power supply need not be replenished or otherwise serviced.

Yet another object of the invention is to link beacon operation to inference that human activity is present.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
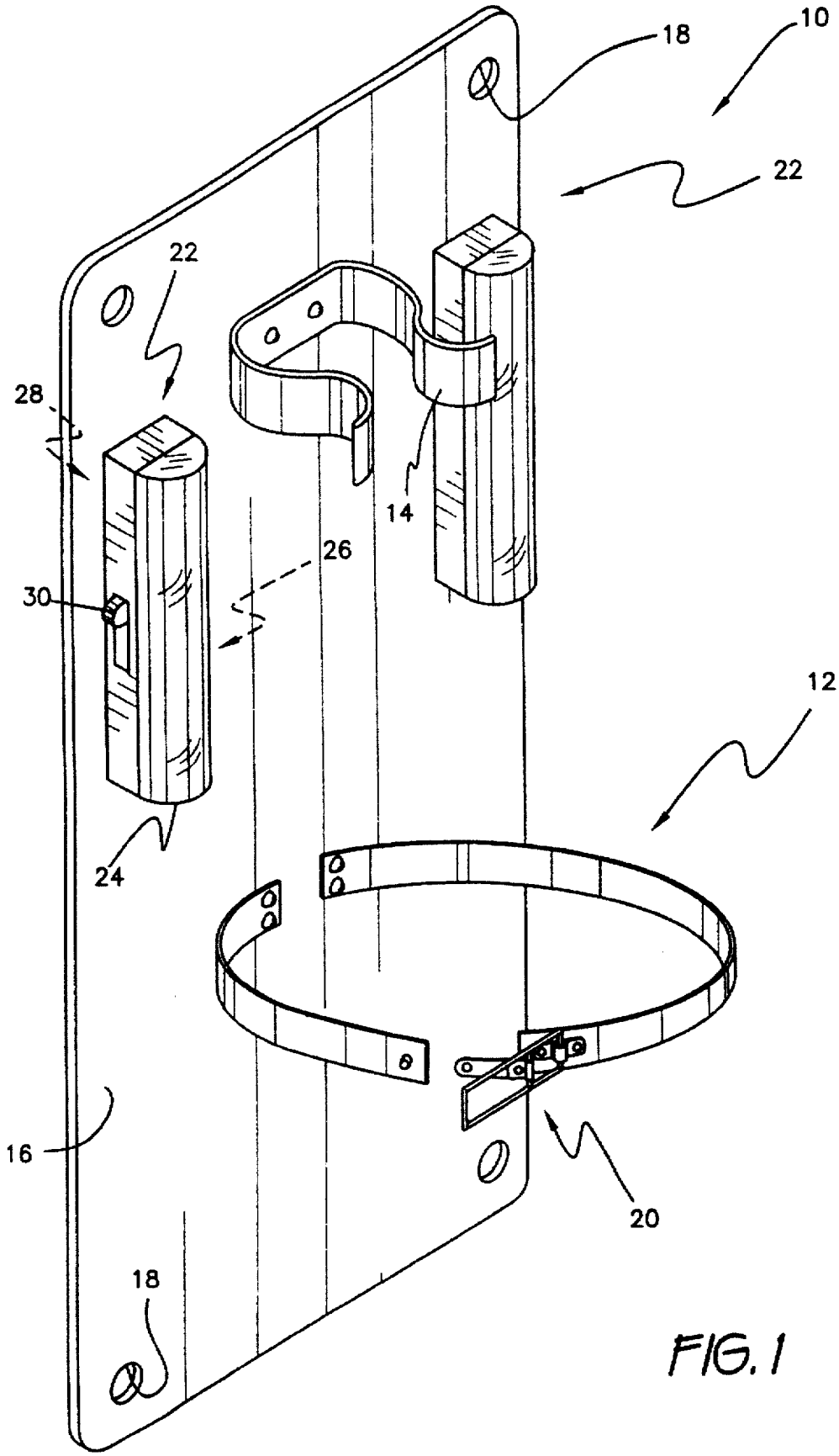
FIG. 1 is a front perspective view of a first embodiment of the invention.

Turning now to FIG. 1 of the drawings, bracket 10 is seen to comprise a band 12 and a clip 14 fixed to a base plate 16. Base plate 16 has holes 18 for accepting fasteners (not shown) enabling bracket 10 to be mounted to a vertical environmental surface. Band 12 encircles and thus partially surrounds an elongated object (not shown) which is to be supported by bracket 10. Band 12 has a suitable latch 20 for securing the supported object to bracket 10.

Components described thus far are generally conventional. Bracket 10 is distinguished from prior art brackets by provision of two visible beacons in the form of lighting fixtures 22. Each lighting fixture 22 has a lens 24, a lamp 26, a battery 28, and a switch 30. Each lighting fixture is thus self-contained, and independent of connection to external power.

The two lighting fixtures 22 are provided so that when a fire extinguisher or other elongated object is secured to bracket 10, light emanating from one lighting fixture 22 will be visible from every viewing direction. That is, the fire extinguisher will not conceal all light, as might occur if only one lighting fixture 22 were provided.

Figure 2:
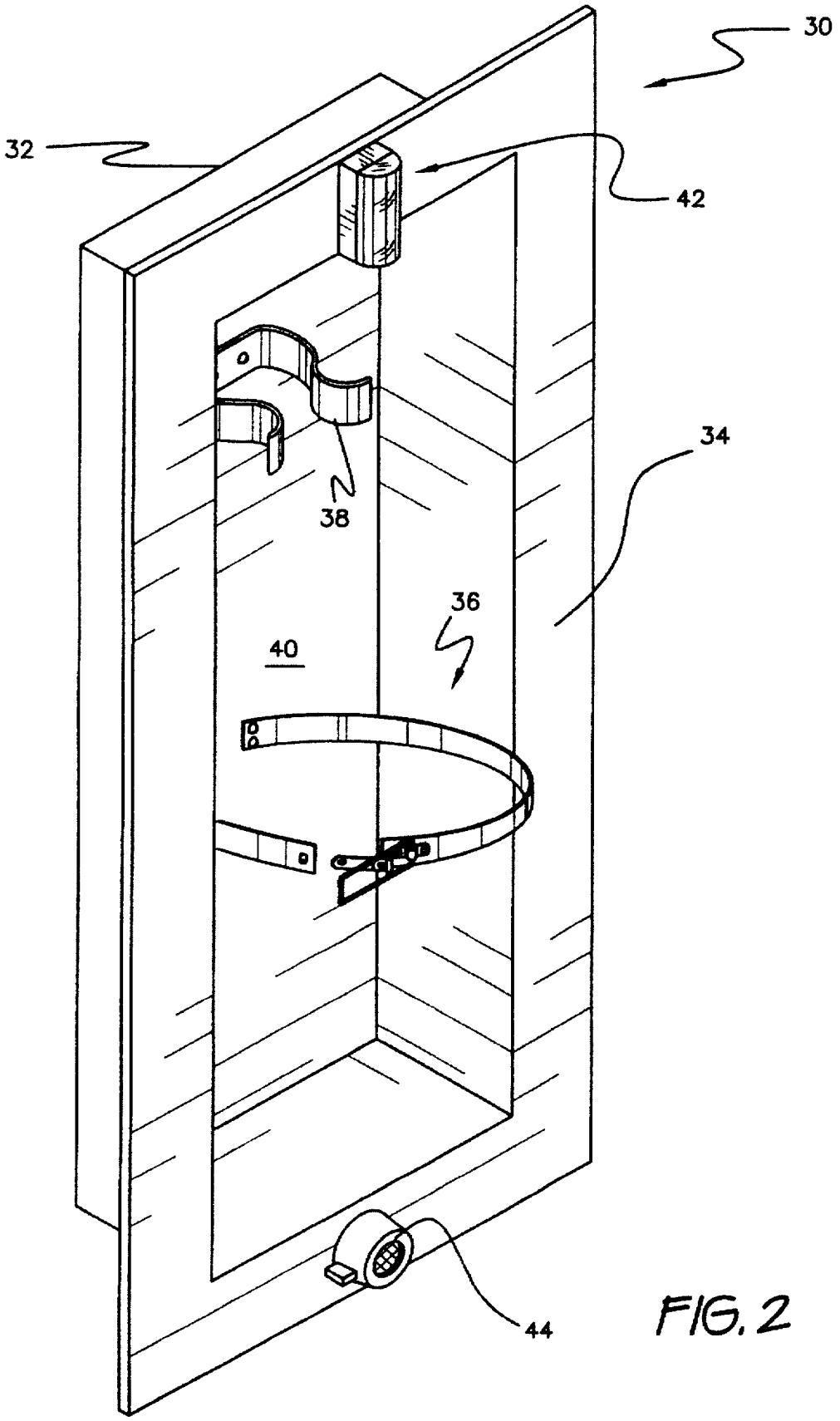
FIG. 2 is a perspective view of a second embodiment of the invention.

The embodiment of FIG. 1 is intended for mounting on a wall of a room or corridor of a building or a mobile structure, such as a motor vehicle. A second embodiment is shown in FIG. 2. Bracket 30 is intended for flush mounting in a wall or other vertical environmental surface. To this end, bracket 30 has a recessed cabinet 32 and a trim flange or plaster ring 34. Cabinet 32 is intended to occupy a cavity formed in the wall, and is inserted into the cavity during installation until plaster ring 34 abuts the wall.

Cabinet 32 is preferably of a depth sufficient so that a fire extinguisher may be housed therein and not project forwardly of plaster ring 34. Optionally, a door (not shown) or other closure may be hinged to or otherwise fastened to cabinet 32.

Bracket 30 has a band 36 and a clip 38 mounted on the rear wall 40 of bracket 30. Band 36 and clip 38 are essentially similar to those of the embodiment of FIG. 1. Because bracket 30 is flush mounted, the fire extinguisher will not obscure beacons provided to render bracket 30, and thus the fire extinguisher, conspicuous. Therefore, beacons need not be duplicated, as is the case with the embodiment of FIG. 1.

Bracket 30 has a visible beacon 42, which may be substantially identical to lighting fixture 22 of FIG. 1, and therefore will not be described further. Bracket 30 also has an audible beacon in the form of buzzer or chime 44. Chime 44 has a battery and switch (neither shown), but differs from lighting fixture 22 in having an integral sound generator. Both visible beacon 42 and chime 44 are provided so that in the event of a fire, location of the fire extinguisher will be apparent to all occupants, sighted or blind, and with or without ambient lighting being present in the structure having bracket 30.

Figure 3:
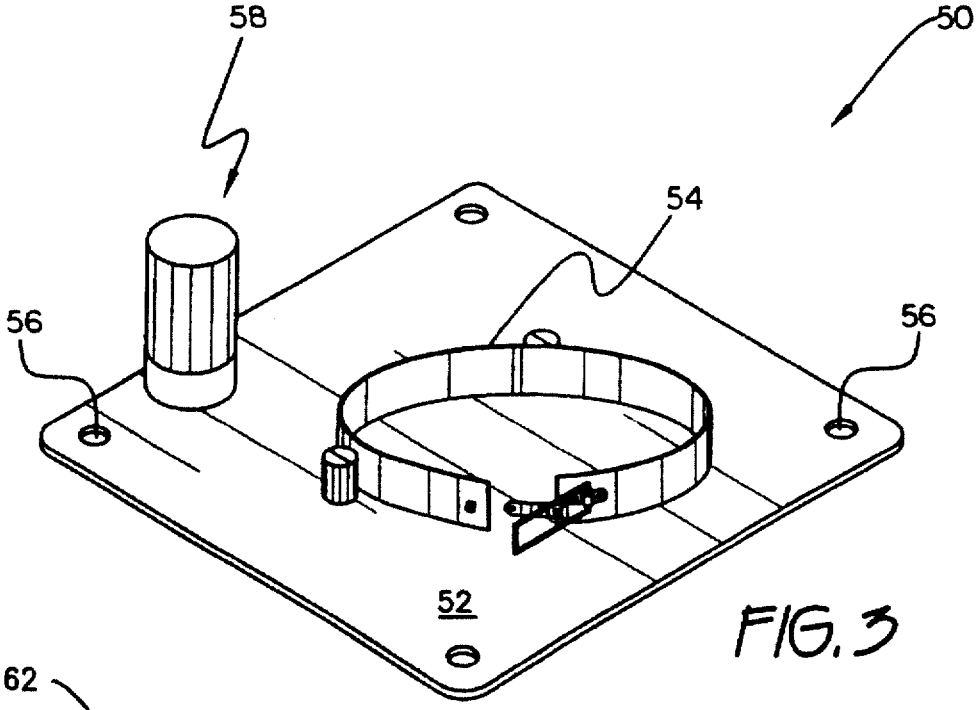
FIG. 3 is a perspective view of a third embodiment of the invention.

Referring now to FIG. 3, bracket 50 supports a fire extinguisher in an upright orientation in a manner similar to those of brackets 10 and 30. However, bracket 50 is adapted to be mounted on a horizontal surface such as a countertop, floor, or upper surface of a table. Bracket 50 includes a base plate 52, a band 54 for securing the fire extinguisher, and holes 56 for accepting fasteners. Band 54 is fixed to base plate 52 so that the fire extinguisher will be vertically oriented when base plate 52 occupies a horizontal plane. A lighting fixture 58 is mounted to base plate 52, and serves as a source of visible light. Lighting fixture 58 has battery, switch, and lamp which are essentially similar to those of lighting fixture 22 of FIG. 1. However, lighting fixture 58 is configured and located to be visible even when a fire extinguisher is in place, supported by bracket 50.

Figure 4:
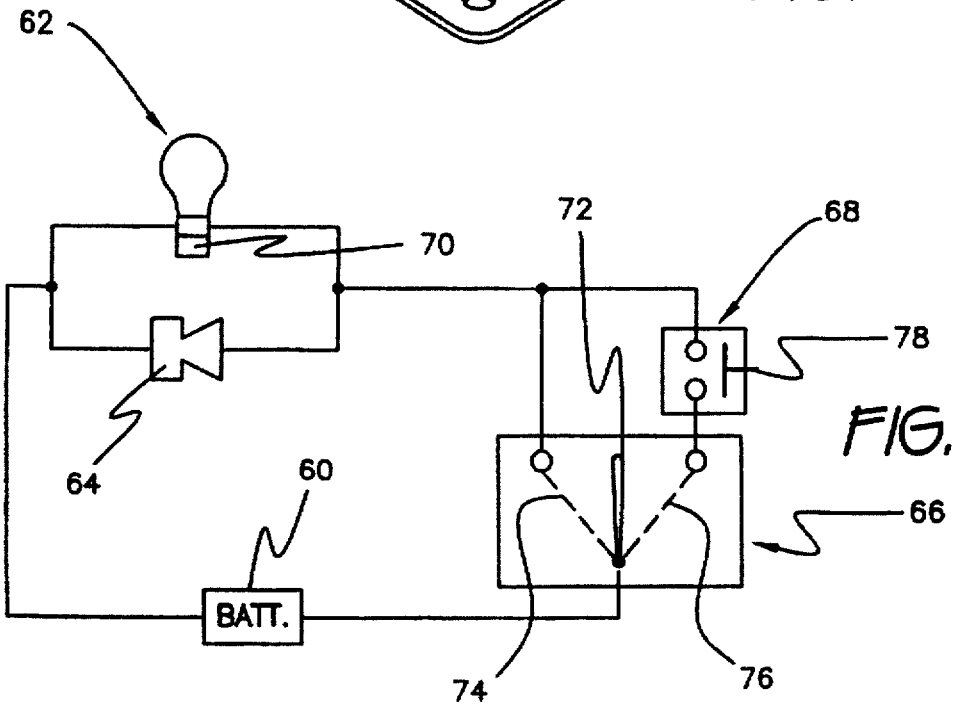
FIG. 4 is an electrical schematic of the power circuit of a further embodiment of the invention.

FIG. 4 illustrates an electrical power circuit serving beacons provided for a bracket provided with one or more beacons. The circuit includes a battery 60, a visible beacon 62, and audible beacon 64, a manual switch 66, and an automatic switch 68. Visible beacon 62 is any suitable lighting fixture. Optionally, beacon 62 includes a flasher 70. Flasher 70 is any suitable device for periodically interrupting power to beacon 62, with the result that beacon 62 flashes or illuminates intermittently. If desired, audible beacon 64, which may be any suitable buzzer or chime, may also be provided with a device interrupting power periodically so that beacon 64 operates intermittently.

Switch 66 provides three switching conditions affording control over the mode of operation of beacons 62, 64. In one condition, that corresponding to a position of a dial or operating lever shown at 72, power to beacons 62, 64 is disconnected from battery 60. A representative operating lever is shown in solid lines in position 72 in the depiction of FIG. 4.

The operating lever may also be moved to a second position indicated in broken lines at 74. in this position, the switch will connect power from battery 60 to beacons 62, 64, so that beacons 62, 64 are operating. In the third condition, indicated in broken lines at 76, power is connected to beacons 62, 64 through automatic switch 68. Beacons 62, 64 thus operate responsively to a condition actuating switch 68.

Automatic switch 68 responds to a condition which a user may wish to monitor in order to cause beacons 62, 64 to operate. In the example of FIG. 4, switch 68 is a proximity switch having a plunger 78. Switch 68 is physically located in an appropriate place on a bracket 10, 30, or 50 so that placement of a fire extinguisher in the intended position for storage causes the fire extinguisher to contact and deflect plunger 78. Deflection of plunger 78 closes the circuit, and beacons 62, 64 operate. Therefore, operation of beacons 62, 64 is limited to times when a fire extinguisher is actually placed in and supported by bracket 10, 30, or 50. At other times, power of battery 60 is conserved. Also, no sound or light are generated which could potentially distract persons present and engaged in various activities.

Figure 5:
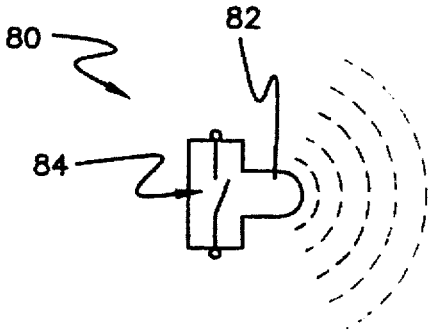
FIG. 5 is a diagrammatic detail view of an alternative form of a switch employed in the circuit of FIG. 4.

Other conditions may be monitored to effect operation of beacons 62, 64. As seen in FIG. 5, an automatic switch 80 comprises a motion detector 82. Motion detector 82 has associated contacts 84 closing a circuit when motion is detected. In a building, it is a reasonable assumption that people are frequently moving, and that human presence may be inferred by detection of motion. This arrangement assures that beacons 62, 64 are operative when persons are present, and that battery power is conserved when no occupants are present.

Other arrangements of brackets 10, 30, and 50, and associated power circuits are possible. More than one type of automatic switch may be provided. For example, an additional automatic switch incorporating a light detector may be employed to operate beacon 62 when ambient light falls below a predetermined threshold.

An automatic switch may be bypassed in connecting a beacon 62 or 64. For example, audible beacon 64 may be arranged to operate regardless of detection of light.

The number, nature, and location of beacons may be varied to suit preferences. Control of beacons may also be varied.

Thus there has been described a bracket primarily although not necessarily devoted to a fire extinguisher, the bracket being improved by beacons signalling the location of the bracket and hence of a fire extinguisher. The bracket is distinguished from other supports by the characteristic that it includes structure for supporting an elongated object in a substantially fixed position relative to the bracket by partial encirclement or surrounding. If the band or equivalent structure for engaging the object is elastic or deformable, some incidental movement of the object may occur.

This structure is unlike a support structure such as a cabinet having shelves, which do not engage secured objects by partial encirclement or surrounding, and thus do not secure their supported objects in a substantially fixed position. Also, a bracket secures its subject object in a location substantially centered relative to the bracket. If the bracket is modified to support plural objects, then the plural objects, when all are present and supported, will collectively be centered relative to the bracket.

It is to be understood that the present invention is not limited to the embodiments described above, but encompasses any and all embodiments within the scope of the following claims.

I claim:

1. A bracket having:

support apparatus for at least partially encircling and thereby supporting an elongate object in a constant orientation;

mounting apparatus for mounting said bracket to an environmental surface in a fixed location;

a beacon fixed to said bracket, for rendering said bracket conspicuous, said beacon comprising a source of visible light a battery for powering said beacon;

circuitry for operably connecting said battery to said beacon, said circuitry including a proximity switch arranged to close said circuitry and cause said beacon to emit visible light when an elongate object is placed in and supported by said bracket.

2. The bracket according to claim 1, further including a flasher for causing said source of visible light to illuminate intermittently.

3. The bracket according to claim 1, said beacon comprising both a source of visible light and a sound generator.

4. The bracket according to claim 1, said circuitry further comprising a manual switch for controlling said beacon.

5. The bracket according to claim 1, said circuitry further comprising a motion detector disposed to operate said beacon responsive to detecting motion.

6. The bracket according to claim 1, said circuitry further comprising three switching conditions including a first switching condition wherein said circuitry is disconnected from said battery, a second switching condition wherein said circuitry connects said battery to said beacon, and a third switching condition wherein said circuitry connects said battery to said beacon through an automatic switch, whereby a user has a choice of causing said beacon to be inoperative, causing said beacon to operate, and causing said beacon to operate responsive to a condition actuating said automatic switch.

7. A bracket having:

support apparatus for at least partially encircling and thereby supporting an elongated object in a constant orientation;

mounting apparatus for mounting said bracket to an environmental surface in a fixed location;

a beacon fixed to said bracket, for rendering said bracket conspicuous;

a battery for powering said beacon, and circuitry for operably connecting said battery to said beacon, said circuitry further comprising a manual switch and an automatic switch for controlling said beacon, arranged to effect three switching conditions including a first switching condition wherein said circuitry is disconnected from said battery, a second switching condition wherein said circuitry connects said battery to said beacon, and a third switching condition wherein said circuitry connects said battery to said beacon through an automatic switch, whereby a user has a choice of causing said beacon to be inoperative, causing said beacon to operate, and causing said beacon to operate responsive to a condition actuating said automatic switch.

8. The bracket according to claim 7, said beacon comprising a source of visible light and a flasher for causing said source of visible light to illuminate intermittently.

9. The bracket according to claim 1, said beacon further comprising a sound generator.

10. The bracket according to claim 7, said automatic switch comprising a motion detector disposed to close said circuitry to said beacon responsive to detection of motion.

11. The bracket according to claim 7, said automatic switch comprising a proximity switch arranged to close said circuitry responsive to an elongated object being placed in and supported by said bracket.

* * * * *